US008038288B2

(12) United States Patent
Motoharu

(10) Patent No.: US 8,038,288 B2
(45) Date of Patent: Oct. 18, 2011

(54) LIQUID EJECTING APPARATUS

(75) Inventor: Habata Motoharu, Wakayama (JP)

(73) Assignee: Seiko Epson Corporation, Tokyo (JP)

( * ) Notice: Subject to any disclaimer, the term of this patent is extended or adjusted under 35 U.S.C. 154(b) by 548 days.

(21) Appl. No.: 12/234,163

(22) Filed: Sep. 19, 2008

(65) Prior Publication Data

US 2009/0079795 A1 Mar. 26, 2009

(30) Foreign Application Priority Data

Sep. 20, 2007 (JP) ..... 2007-243878
Aug. 11, 2008 (JP) ..... 2008-207012

(51) Int. Cl.
*B41J 2/01* (2006.01)

(52) U.S. Cl. ..... 347/104; 347/101

(58) Field of Classification Search ..... 347/103, 347/104, 102, 101
See application file for complete search history.

(56) References Cited

U.S. PATENT DOCUMENTS

| | | | | |
|---|---|---|---|---|
| 5,510,822 | A * | 4/1996 | Vincent et al. | 347/102 |
| 6,168,269 | B1 * | 1/2001 | Rasmussen et al. | 347/102 |
| 6,328,440 | B1 * | 12/2001 | Medin et al. | 347/104 |
| 2005/0195264 | A1 * | 9/2005 | Sootome et al. | 347/104 |

FOREIGN PATENT DOCUMENTS

| | | |
|---|---|---|
| JP | 06-166191 | 6/1994 |
| JP | 2003-270928 | 9/2003 |
| JP | 2006-150723 | 6/2006 |

* cited by examiner

*Primary Examiner* — Manish S Shah
(74) *Attorney, Agent, or Firm* — Workman Nydegger

(57) ABSTRACT

A liquid ejecting apparatus includes a supporting member that supports a target transported from the upstream side; a liquid ejecting head that ejects liquid toward the target supported by the supporting member; a supporting mechanism that supports the supporting member; and a heating device that heats the supporting member, in which the supporting mechanism supports the supporting member so as to allow the supporting member to be thermally expanded in the direction parallel to a supporting surface of the supporting member, which is a surface that supports the target.

7 Claims, 5 Drawing Sheets

LIQUID EJECTING APPARATUS

BACKGROUND

1. Technical Field

The present invention relates to a liquid ejecting apparatus such as ink jet printer.

2. Related Art

In general, an ink jet printer (hereinafter, referred to as a "printer") is widely known as a liquid ejecting apparatus which ejects liquid to a target (for example, JP-A-2006-150723). The printer described in JP-A-2006-150723 includes a platen (supporting member) for supporting an elongated printing medium (target) and a printhead (liquid ejecting head) for ejecting ink (liquid) to the printing medium supported by the platen.

Then, in a state in which the recording medium is transported onto the platen from upstream side in the direction of transport of the recording medium and is stopped temporarily, the printer in JP-A-2006-150723 performs a printing job by ejecting ink from a printhead on the recording medium and, after having finished the printing job, transports the recording medium on the platen to the downstream side.

In the printer disclosed in JP-A-2006-150723, the recording medium supported on the platen is heated by a heating unit (heating device) via the platen in order to enhance the fixing ability of ink dropped on the recording medium during the printing job. Therefore, when the platen is fixed completely by screws at a plurality of positions, the platen is heated and is thermally expanded in the horizontal direction, and hence there arises a problem such that a surface of the platen which supports the recording medium is deformed and becomes wavy between the screws.

SUMMARY

An advantage of some aspects of the invention is that a liquid ejecting apparatus configured in such a manner that when a supporting member for supporting a target is heated and hence is thermally expanded, a thermally expanded amount of the supporting member is absorbed.

A liquid ejecting apparatus according to an aspect of the invention includes a supporting member that supports a target transported from the upstream side; a liquid ejecting head that ejects liquid toward the target supported by the supporting member; a supporting mechanism that supports the supporting member; and a heating device that heats the supporting member, in which the supporting mechanism supports the supporting member so as to allow the supporting member to be thermally expanded in the direction parallel to a supporting surface of the supporting member, which is a surface for supporting the target.

In this configuration, when the supporting member is heated and is thermally expanded in the direction parallel to the supporting surface, absorption of the thermally expanded portion of the supporting member is enabled.

A liquid ejecting apparatus according to another aspect of the invention includes a supporting member that supports a target transported from the upstream side; a liquid ejecting head that ejects liquid toward the target supported by the supporting member; a supporting mechanism that supports the supporting member; and a heating device that heats the supporting member, in which the supporting mechanism includes a first supporting mechanism that positions the supporting member from the side opposite from a supporting surface which is a surface of the supporting member for supporting the target and is apart from the supporting member in the direction parallel to the supporting surface, and a second supporting mechanism that positions the supporting member from the side of the supporting surface, which is the surface of the supporting member for supporting the target and is apart from the supporting member in the direction parallel to the supporting surface.

In this configuration, when the supporting member is heated and is thermally expanded in the direction parallel to the supporting surface, absorption of the thermally expanded portion of the supporting member is enabled while restraining the supporting member from rattling in the direction intersecting the supporting surface.

Preferably, the first supporting mechanism and the second supporting mechanism each include a supporting member that is able to support the supporting member, and the first supporting mechanism supports the supporting member and positions the supporting member by bringing a first positioning portion of the supporting member into contact with the supporting member, and the second supporting mechanism positions the supporting member by brining a second positioning portion of a press-holding member supported by the supporting member via the supporting portion into contact with the supporting member.

In this configuration, the first supporting mechanism positions the supporting member by bringing the first positioning portion into contact with the supporting member from the side opposite from the supporting surface, and the second supporting mechanism positions the supporting member by bringing the second positioning portion into contact with the supporting member from the side of the supporting surface. Therefore, the supporting member is positioned without being fixed completely. Therefore, the supporting member is restrained from being thermally expanded and hence deformed to become wavy. In the second supporting mechanism, since the press-holding member is supported by the supporting member, the press-holding member is commonly used with the member of the first supporting mechanism.

Preferably, the supporting portion of the press-holding member is inserted into a through hole formed on the supporting member with a gap for accommodating thermal expansion of the supporting member.

In this configuration, since the supporting portion of the press-holding member is inserted into the through hole formed on the supporting member with a gap for accommodating the thermal expansion of the supporting member, the thermal expansion of the supporting member is accommodated. Since the supporting portion of the press-holding member is inserted into the through hole formed on the supporting member, flexibility in arrangement of the second supporting mechanism is increased.

Preferably, the first supporting mechanism and the second supporting mechanism each include the supporting member and the press-holding member, and the supporting member and the press-holding member are able to move with respect to the supporting member in a state in which the first positioning portion and the second positioning portion are kept at a distance which prevents the supporting member from being nipped.

In this configuration, in the first supporting mechanism and the second supporting mechanism, the supporting member and the press-holding member are kept at a distance which prevents the supporting member from being nipped between the first positioning portion and the second positioning portion. Therefore, the supporting member is not completely fixed. Since the first supporting mechanism and the second supporting mechanism each include the supporting member and the press-holding member which are adapted to be able to move relatively with the supporting member, changeover of the first supporting mechanism and the second supporting mechanism is easily achieved by moving these members with respect to the supporting member.

Preferably, in at least the second supporting mechanism from between the first supporting mechanism and the second supporting mechanism, a spacer which comes into contact with both the first positioning portion and the second positioning portion is provided between the first positioning portion and the second positioning portion with a gap for accommodating the thermal expansion of the supporting member provided with respect to the supporting member.

In this configuration, the length of the spacer may be set to a length corresponding to the distance which prevents the supporting member from being nipped between the first positioning portion and the second positioning portion, so that the distance between the first positioning portion and the second positioning portion is kept constant (the distance corresponding to the length of the spacer) further easily and accurately. Since the spacer is provided with the gap for accommodating the thermal expansion of the supporting member with respect to the supporting member, the thermal expansion of the supporting member is accommodated.

Preferably, the spacer is formed of a material having a smaller coefficient of thermal expansion than that of the material which constitutes the supporting member.

In this configuration, since the amount of thermal expansion of the spacer is smaller than the amount of thermal expansion of the supporting member, even when the supporting member is thermally expanded in the direction parallel to the supporting surface, the gap formed between the spacer and the supporting member can be secured.

Preferably, the distance between the supporting member and the first supporting mechanism in the direction parallel to the supporting surface and the distance between the supporting member and the second supporting mechanism in the direction parallel to the supporting surface each are set to an extent that is able to absorb the amount of thermal expansion of the supporting member in the direction parallel to the supporting surface.

In this configuration, when the supporting member is heated and is thermally expanded in the direction parallel to the supporting surface, absorption of the thermally expanded portion of the supporting member is ensured.

Preferably, the first supporting mechanism and the second supporting mechanism are arranged alternately.

In this configuration, since the first supporting mechanism and the second supporting mechanism position the supporting member from the side opposite from the supporting surface and from the side of the supporting surface in a balanced manner, when the supporting member is heated and is thermally expanded in the direction parallel to the supporting surface, the supporting member is preferably prevented from rattling in the direction intersecting the supporting surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
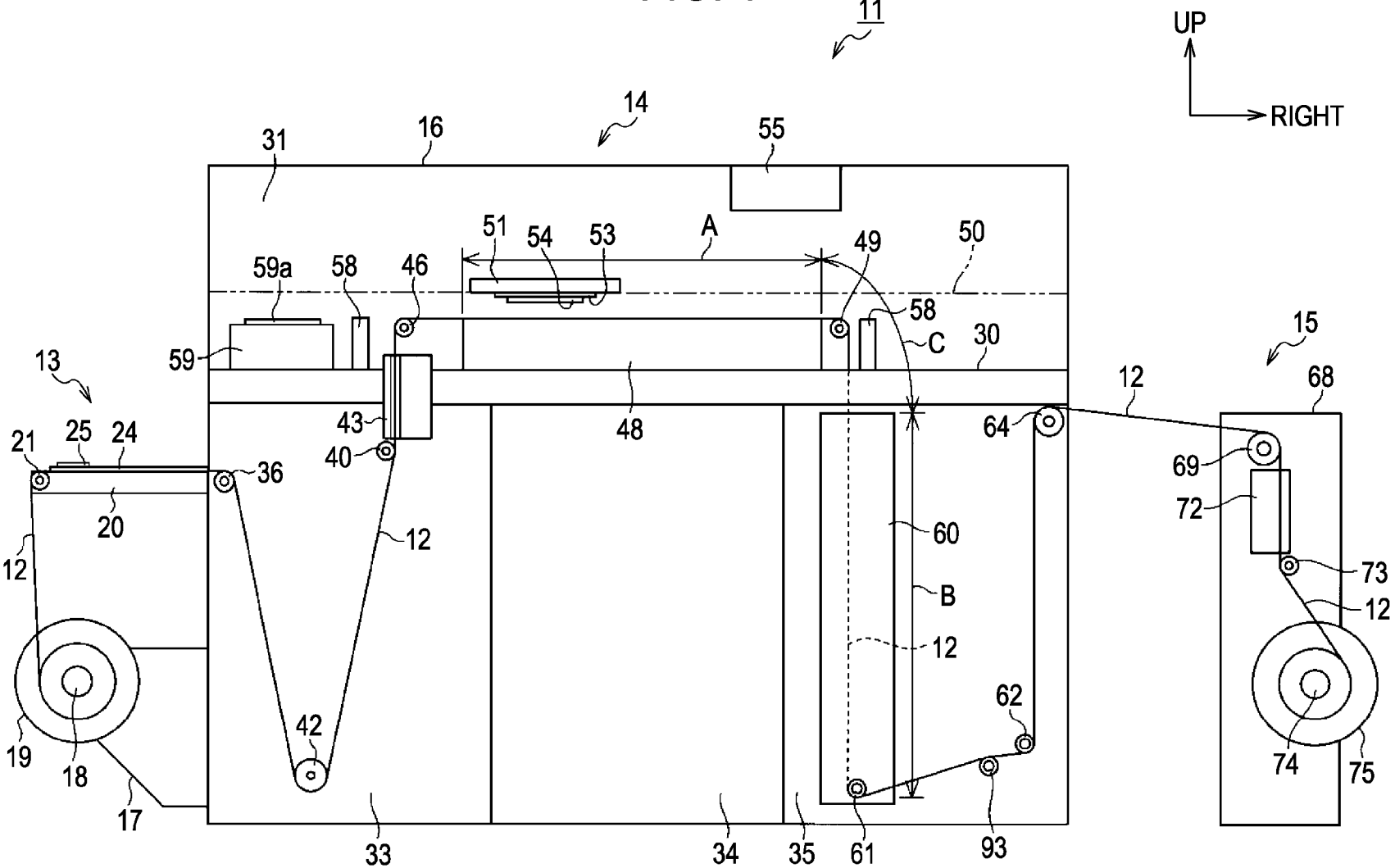
FIG. 1 is a schematic front view of an ink jet printer according to an embodiment.

Referring now to the drawings, an embodiment in which a liquid ejecting apparatus in an aspect of the invention is applied to an ink jet printer will be described. In the description shown below, the terms "fore-and-aft direction", "lateral direction" and "vertical direction" indicate directions with respect to the directions indicated by arrows in FIG. 1 and FIG. 2.

As shown in FIG. 1, an ink jet printer 11 as a liquid ejecting apparatus includes a feeding unit 13 that feeds a continuous sheet 12 as an elongated target, a main body 14 that performs a printing job on the continuous sheet 12 fed from the feeding unit 13 in sequence and dries the same, and a winding unit 15 that winds the continuous sheet 12 after having printed thereon and dried by the main body 14. In other words, the main body 14 includes a rectangular parallelepiped body case 16, the feeding unit 13 is disposed on the left side of the body case 16, which is the upstream side in the direction of transport of the continuous sheet 12, and the winding unit 15 is disposed on the right side of the body case 16, which is the downstream side.

The feeding unit 13 includes a supporting panel 17 extending leftward from the lower end portion on the left surface of the body case 16, and the front surface of the supporting panel 17 is a vertical surface. A winding shaft 18 extending forward (the near side in the direction orthogonal to the paper plane in FIG. 1) is supported by the supporting panel 17 at the distal end portion on the front surface thereof. A disk-shaped rotating panel 19 is provided at the proximal end of the winding shaft 18 so as to rotate integrally therewith.

The continuous sheet 12 rolled in advance is supported by the winding shaft 18 so as to rotate integrally with the winding shaft 18, and one of the side edges of the rolled continuous sheet 12 on the side of the rotating panel 19 comes into contact with the front surface of the rotating panel 19. In other words, when the continuous sheet 12 rolled in advance is supported by the winding shaft 18, one of the side edges of the continuous sheet 12 in a state of being rolled comes into contact with the front surface of the rotating panel 19, and hence is positioned in the fore-and-aft direction which is orthogonal to the direction of transport of the continuous sheet 12. The continuous sheet 12 employed in this embodiment is a glossy paper.

Figure 2:
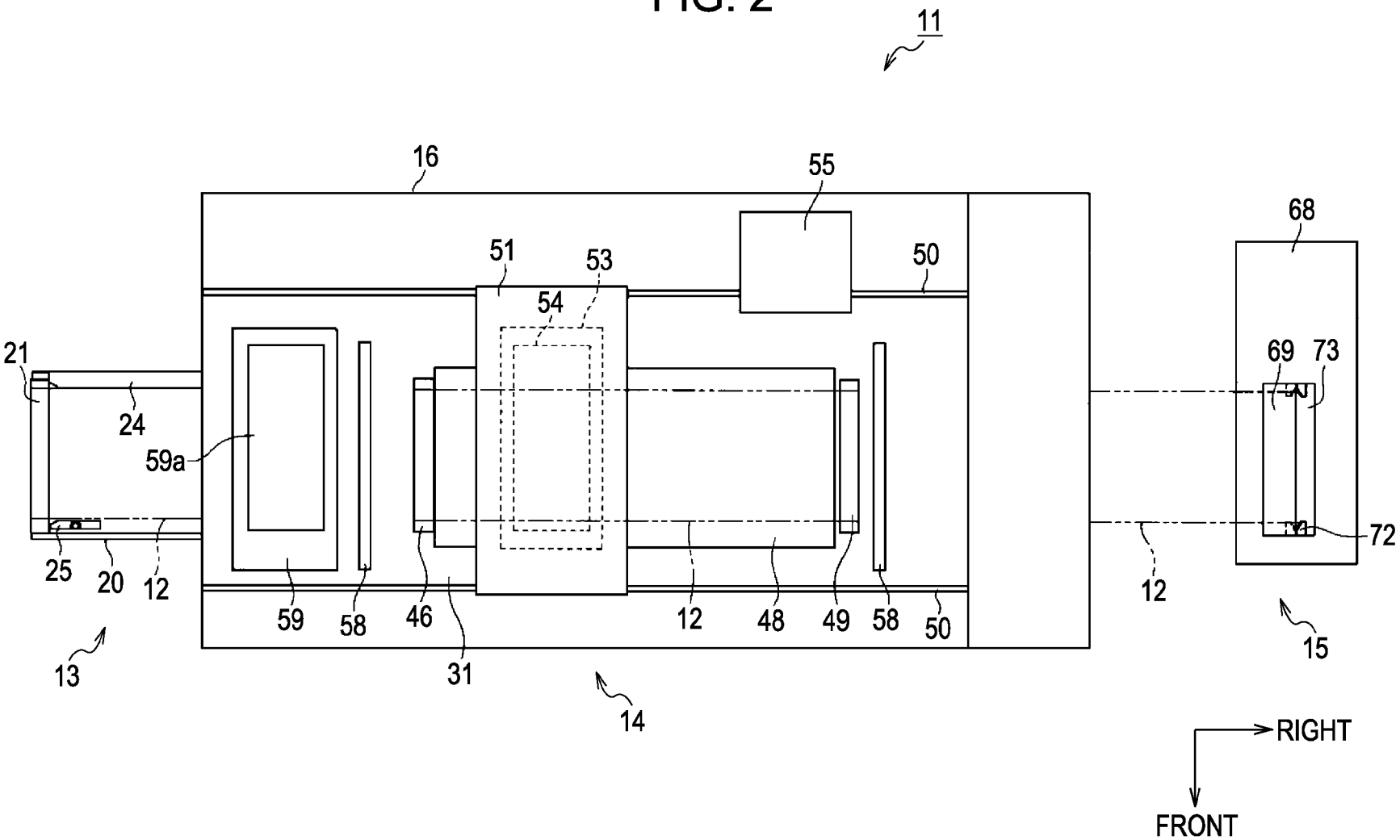
FIG. 2 is a schematic plan view of the same printer.

As shown in FIG. 1 and FIG. 2, the feeding unit 13 is provided with a flat-plate shaped feeding base 20 extending horizontally leftward from the center portion of the left surface of the body case 16, and a relay roller 21 for winding the continuous sheet 12 fed from the winding shaft 18 to guide the same to the upper surface of the feeding base 20 is rotatably provided at the distal end portion of the feeding base 20.

As shown in FIG. 2, a guide portion 24 as guiding means in the shape of an elongated block extending in the lateral direction is provided substantially entirely over a rear end edge of the upper surface of the feeding base 20. A guide block 25 as guiding means arranged so as to oppose the left end portion of the guide portion 24 is provided on the upper surface of the feeding base 20. An area between the guide portion 24 and the guide block 25 on the upper surface of the feeding base 20 corresponds to part of a transport path of the continuous sheet 12, and the guide portion 24 and the guide block 25 are apart from each other by a distance corresponding to the width of the continuous sheet 12 in the fore-and-aft direction of the same.

Then, when the continuous sheet 12 is transported rightward (toward the main body 14) along the upper surface of the feeding base 20, the front and rear side edges of the continuous sheet 12 slide along the guide portion 24 and the guide block 25, so that the continuous sheet 12 is guided along the direction of transport (rightward in this case). The guide block 25 is adapted to be able to move in the fore-and-aft direction on the upper surface of the feeding base 20, and when the width of the continuous sheet 12 in the fore-and-aft direction is changed, the distance between the guide portion 24 and the guide block 25 is changed to match the width of the continuous sheet 12 in the fore-and-aft direction by moving the guide block 25.

As shown in FIG. 1, a base 30 as a flat plate-shaped base member, which partitions the interior of the body case 16 in the vertical direction, is provided at a raised position with respect to the vertical center in the body case 16 of the main body 14, and an area on the upper side of the base 30 in the body case 16 corresponds to a printing chamber 31 for performing a printing job on the continuous sheet 12. In contrast, three compartments 33, 34, and 35 partitioned in the lateral direction in line are formed in an area lower than the base 30 in the body case 16. These three compartments are the first compartment 33, the second compartment 34, and the third compartment 35 in sequence from the left.

An inlet port, not shown, for carrying the continuous sheet 12 in the first compartment 33 from the upper surface of the feeding base 20 is provided on a left wall of the body case 16, and a lead-in roller 36 is rotatably provided in the first compartment 33 so as to oppose the inlet port in the proximity thereof. In other words, the lead-in roller 36 is disposed on the left end portion of the first compartment 33.

A relay roller 40 is rotatably provided on the right side of the lead-in roller 36 in the first compartment 33. The continuous sheet 12 led into the first compartment 33 by driving the lead-in roller 36 is wound around the relay roller 40 so as to be directed to a position to the left end portion in the printing chamber 31.

An elevating roller 42 which moves up and down by driving an elevator mechanism, not shown, is provided between the lead-in roller 36 and the relay roller 40 in the first compartment 33. The continuous sheet 12 is wound around the elevating roller 42 from the lower side.

Here, the length of the continuous sheet 12 positioned between the lead-in roller 36 and the relay roller 40 is increased with the downward movement of the elevating roller 42 and decreased with the upward movement of the elevating roller 42. In other words, the lower the position of the elevating roller 42 is, the longer the distance of transport of the continuous sheet 12 between the lead-in roller 36 and the relay roller 40 becomes, while the upper the position of the elevating roller 42 is, shorter the distance of transport of the continuous sheet 12 between the lead-in roller 36 and the relay roller 40 becomes.

As shown in FIG. 1, a guiding device 43 that guides the continuous sheet 12 in the direction of transport (upward in this case) so as to penetrate in the vertical direction through the base 30 is provided at a position on the base 30 opposing the relay roller 40. A relay roller 46 is provided on the upper side of the guiding device 43 in the printing chamber 31, and the continuous sheet 12 is wound around the relay roller 46 from the lower left side and is transported horizontally rightward.

A platen 48 as a rectangular plate-shaped supporting member supported on the base 30 is provided in an area on the right side of the relay roller 46 in the printing chamber 31. A redirecting roller 49 is provided on the right side of the platen 48 so as to oppose the relay roller 46 with the intermediary of the platen 48. In this case, the upper surface of the relay roller 46, the upper surface of the platen 48, and the upper surface of the redirecting roller 49 are flush with each other.

The continuous sheet 12 transported from the relay roller 46 horizontally rightward along the upper surface of the platen 48 is wound around the redirecting roller 49 from the upper left side and the direction of transport of the continuous sheet 12 is redirected from horizontally rightward to the vertically downward. The continuous sheet 12 whose direction of transport is redirected to vertically downward by the redirecting roller 49 is then transported into the third compartment 35 through an insertion hole, not shown, provided on the base 30.

Guide rails 50 extending in the lateral direction (shown by double-dashed lines in FIG. 1) are provided in pair on both sides of the platen 48 in the fore-and-aft direction in the printing chamber 31, and the upper surfaces of the guide rails 50 are higher than the upper surface of the platen 48. A rectangular plate-shaped carriage 51 is supported on the upper surfaces of the both guide rails 50 in a state of being capable of reciprocating in the lateral direction along the both guide rails 50. The carriage 51 is adapted to move on the guide rails 50 in the lateral direction on the basis of driving of a driving mechanism, not shown.

As shown in FIG. 1 and FIG. 2, a rectangular plate-shaped sliding plate 53 is supported on the lower surface of the carriage 51 so as to be slidable in the fore-and-aft direction with respect to the carriage 51. A printhead 54 as a liquid ejecting head is supported on the lower surface of the sliding plate 53. A plurality of valve units 55 that store ink as liquid temporarily are provided on an upper portion of a rear wall of the body case 16 in the interior of the printing chamber 31. The valve units 55 include ink having different colors from each other stored temporarily therein.

Then, the respective valve units 55 are connected to the printhead 54 via ink supply tubes, not shown, so that respective colors of ink are supplied to the printhead 54 via the respective ink supply tubes. A plurality of nozzle openings, not shown, are provided on the lower surface of the printhead 54, so that colors of ink supplied from the respective valve units 55 are ejected from the respective nozzle openings to the continuous sheet 12 in a state of having transported on the platen 48 and stopped thereon to achieve the printing job.

Therefore, an area of midsection of the transport path of the continuous sheet 12, which is an area from the left end to the right end of the platen 48 where the printing job on the continuous sheet 12 is performed, corresponds to a printing area A and the continuous sheet 12 is intermittently transported in the transport path of the continuous sheet 12 by the unit of the printing area A.

A plurality of ink cartridges, not shown, including ink in different colors from each other are demountably mounted in the body case 16. The respective ink cartridges (not shown) are connected to the respective valve units 55 via the ink supply tubes, not shown, in a state of being capable of supplying ink. A pressurizing pump (not shown) for pressurizing the interiors of the respective ink cartridges (not shown) is provided in the body case 16, so that the respective colors of ink in the respective ink cartridges (not shown) are pressurized and supplied to the respective valve units 55 via the ink supply tubes (not shown) by driving the pressurizing pump.

Flushing boxes 58 for receiving ink discharged from the respective nozzle openings (not shown) of the printhead 54 when performing flushing as needed during the printing job are provided on the base 30 on both left and right sides of the platen 48. A maintenance unit 59 for performing maintenance such as cleaning of the printhead 54 is provided on the base 30 on the left side of the flushing box 58. The maintenance unit 59 includes a cap 59*a* corresponding to the printhead 54, and the cap 59*a* is capable of moving upward and downward.

The interior of the cap 59*a* communicates with the interior of a waste liquid tank, not shown, via a discharging tube, not shown. A tube pump, not shown, which is able to suck the interior of the discharging tube from the cap 59*a* side toward the waste liquid tank (not shown) is provided at a midpoint of the discharging tube. Then, when moving the cap 59*a* upward in a state in which the carriage 51 is moved onto the maintenance unit 59, the cap 59*a* comes into contact with the printhead 54 so as to surround the respective nozzle openings (not shown) of the printhead 54.

When the tube pump (not shown) is driven in a state in which the cap 59*a* is in contact with the printhead 54 so as to surround the respective nozzle openings (not shown) of the printhead 54, so-called cleaning for causing ink increased in viscosity or air bubbles to be forcedly discharged into the cap 59*a* from the respective nozzle openings of the printhead 54 is carried out. The discharged ink discharged into the cap 59*a* by cleaning is collected in the waste liquid tank (not shown) via the discharge tube (not shown).

As shown in FIG. 1, a vertically elongated forced dryer device 60 as forced drying means for forcedly drying the continuous sheet 12 after having printed in the printing area A is provided in the third compartment 35 at a position to the left. Then, the continuous sheet 12 wound around the redirecting roller 49 and transported vertically downward passes through the forced dryer device 60, then is wound around a reverse roller 61 provided rotatably below the forced dryer device 60 from the upper left side, and then is transported rather obliquely upward and rightward.

In this manner, a midpoint of the transport path of the continuous sheet 12 which corresponds to the an area from the upper end to the lower end in the forced dryer device 60 where the forced drying of the continuous sheet 12 is performed is a forced dry area B. Then, the distance of the forced dry area B in the direction of transport (vertical direction in this case) of the continuous sheet 12 is set to be a positive integral multiples (one fold in this embodiment) of the distance of the printing area A in the direction of transport (lateral direction in this case) of the continuous sheet 12 (in this embodiment, the distance of the forced dry area B and the distance of the printing area A are set to be the same in the direction of transport of the continuous sheet 12).

A midpoint of the transport path of the continuous sheet 12 which corresponds to an area where the continuous sheet 12 is wound around the redirecting roller 49 between the printing area A and the forced dry area B is an area where the continuous sheet 12 after having printed in the printing area A is naturally dried before being forcedly dried in the forced dry area B, and hence is a natural dry area C. In this embodiment, the forced dry area B and the natural dry area C constitute a dry area.

The continuous sheet 12 which has transported from the reverse roller 61 obliquely upward and rightward is wound around a relay roller 62 rotatably provided at the lower right end portion in the third compartment 35 from lower left side, and is transported in the third compartment 35 upward along the right wall of the body case 16. A dancer roller 93 which presses the continuous sheet 12 from the lower side so as to provide a tensile force to the continuous sheet 12 after having forcedly dried in the forced dry area B is provided in the third compartment 35 between the reverse roller 61 and the relay roller 62.

An outlet port, not shown, for carrying out the continuous sheet 12 toward the winding unit 15 is provided on the right wall of the body case 16 at a position corresponding to the upper end portion of the third compartment 35, and a feeding roller 64 is rotatably provided in the third compartment 35 so as to oppose the outlet port in the proximity thereof. Then, the continuous sheet 12 is delivered toward the winding unit 15 via the outlet port by driving the feeding roller 64.

As shown in FIG. 1, the winding unit 15 is provided with a parallel piped winding frame 68, and the height of the winding frame 68 is substantially the same as the height of the feeding roller 64. A relay roller 69 is rotatably provided at the upper end portion of the front surface of the winding frame 68. The continuous sheet 12 fed from the outlet port is wound around the relay roller 69 from the upper left side and is transported right downward.

A guide device 72 that guides the continuous sheet 12 transported from the relay roller 69 right downward along the direction of transport (downward in this case) is provided below the relay roller 69 on the front surface of the winding frame 68. A relay roller 73 is rotatably provided below the guide device 72 on the front surface of the winding frame 68, and the continuous sheet 12 transported and guided downward via the guide device 72 is wound around the relay roller 73 from the left side and is transported obliquely downward and rightward.

A winding drive shaft 74 extending toward the front is supported on the front surface of the winding frame 68 at a position obliquely downward and rightward with respect to the relay roller 73 so as to be capable of rotating with respect to the winding frame 68. The continuous sheet 12 transported from the relay roller 73 obliquely downward and rightward is wound around the winding drive shaft 74, and the continuous sheet 12 is wound around the winding drive shaft 74 in sequence by rotating the winding drive shaft 74.

A disk-shaped rotating panel 75 which rotates integrally with the winding drive shaft 74 is provided at a proximal end of the winding drive shaft 74, and the rotating panel 75 functions as a guide for causing the continuous sheet 12 to be wound accurately when the continuous sheet 12 is wound around the winding drive shaft 74.

Subsequently, a configuration of the forced dryer device 60 will be described in detail.

Figure 3:
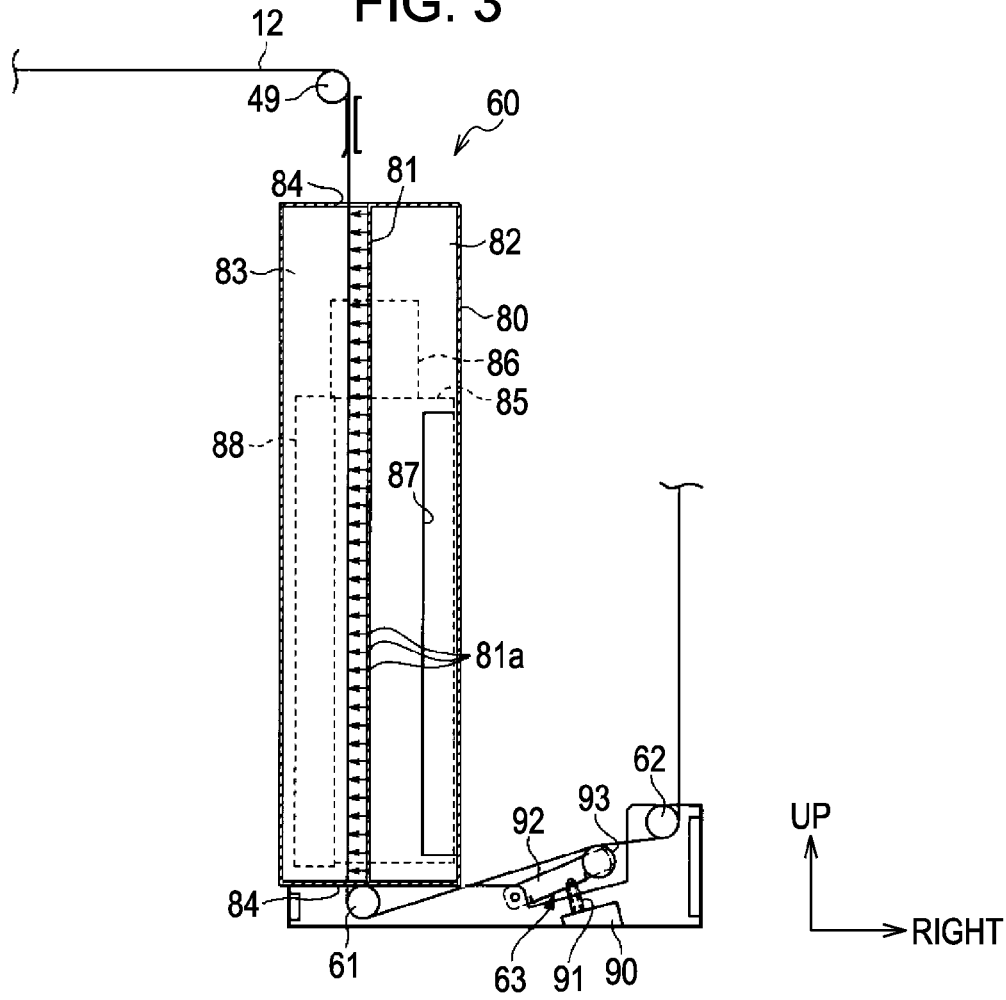
FIG. 3 is an enlarged front cross section of a forced dryer device of the same printer.
Figure 4:
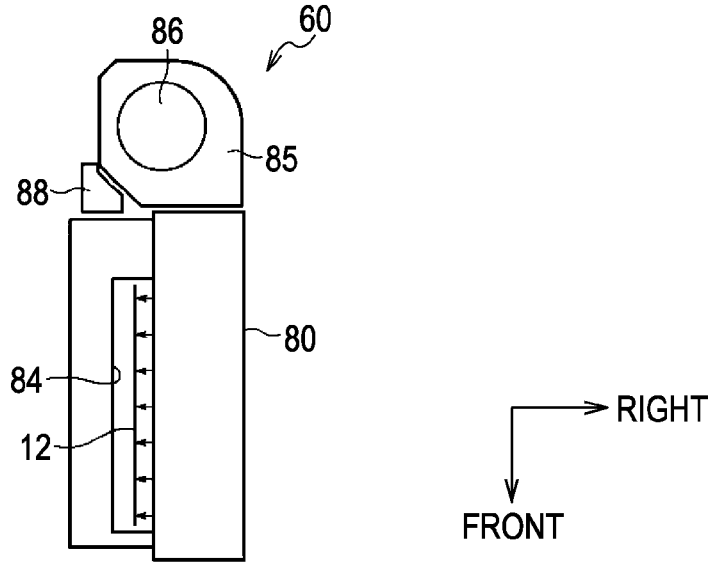
FIG. 4 is an enlarged plan view of the forced dryer device of the same printer.

As shown in FIG. 3 and FIG. 4, the forced dryer device 60 includes a dryer case 80 having a rectangular cross-section, and a partitioning plate 81 that partitions the interior of the dryer case 80 into left and right two compartment is provided substantially at the lateral center in the dryer case 80. In the dryer case 80, the compartment on the right side of the partitioning plate 81 is a hot air delivering chamber 82 to which a hot air is delivered, and a compartment on the left side of the partitioning plate 81 is a dryer chamber 83 that dries the continuous sheet 12 after having printed.

The partitioning plate 81 is formed with a number of communication holes 81*a*, which communicate the hot air delivering chamber 82 and the dryer chamber 83, and the communication holes 81*a* are arranged regularly in the fore-and-aft direction and the lateral direction over the entire partitioning plate 81. In other words, the partitioning plate 81 is formed with a number of the communication holes 81*a* arranged uniformly over the entire partitioning plate 81.

Through holes 84 having a rectangular shape in plan view are formed respectively in upper and lower walls of the dryer case 80 at positions corresponding to the dryer chamber 83 so as to penetrate from the inside to the outside of the dryer chamber 83. Therefore, the continuous sheet 12 transported from the redirecting roller 49 is transported to the reverse roller 61 side through the upper through hole 84 of the dryer case 80, the dryer chamber 83, and the lower through holes 84. In this case, when the continuous sheet 12 is transported in the dryer chamber 83, the front surface thereof which is a printed surface opposes the left surface of the partitioning plate 81.

A blast fan 85 is provided on the rear side of the dryer case 80, and a fan motor 86 for driving the blast fan 85 is provided on the upper surface of the blast fan 85. A blast port, not shown, is provided on the right end side of the front surface of the blast fan 85, and the blast port faces a delivery port 87 provided at a position corresponding to the hot air delivering chamber 82 on a rear wall of the dryer case 80 so as to penetrate from the inside to the outside of the hot air delivering chamber 82.

A heater 88 is provided on the rear side of the dryer case 80 and on the obliquely left front side of the blast fan 85, and the heater 88 faces an air intake port, not shown, provided on the surface between the front surface and the left surface of the blast fan 85. Therefore, air warmed by the heater 88 is taken from the air intake port (not shown) of the blast fan 85 by driving the blast fan 85, and is delivered into the hot air delivering chamber 82 from the blast port (not shown) of the blast fan 85 as hot air.

The surface of the continuous sheet 12 transported in the dryer chamber 83 is uniformly blasted by hot air delivered into the hot air delivering chamber 82 through the respective communication holes 81*a* provided on the partitioning plate 81, and hence the continuous sheet 12 is forcedly and uniformly dried. Arrows in FIG. 3 and FIG. 4 indicate the hot air that is blasted on the surface of the continuous sheet 12.

Subsequently, a configuration of the pressing unit having the dancer roller 93 will be described in detail.

As shown in FIG. 3, the pressing unit 63 as the pressing means includes a seat 90 fixed to the inner bottom surface of the third compartment 35 (see FIG. 1) and having an upper surface inclined leftward. A coil spring 91 as the resilient member is provided upright on the upper surface of the seat 90, and a frame-shaped roller supporting member 92 is supported at the distal end (upper end) of the coil spring 91. The dancer roller 93 as the pressing member is supported by the roller supporting member 92 so as to be rotatable with respect to the roller supporting member 92, and the dancer roller 93 comes into contact with the reverse surface of the continuous sheet 12 which is the opposite surface from the printed surface.

In this case, the dancer roller 93 is always urged upward toward the continuous sheet 12 by the coil spring 91 via the roller supporting member 92. Therefore, the dancer roller 93 always presses the reverse surface of the continuous sheet 12 so as to provide a tensile force to the continuous sheet 12.

Subsequently, a heating device for heating the platen 48 will be described.

Figure 5:
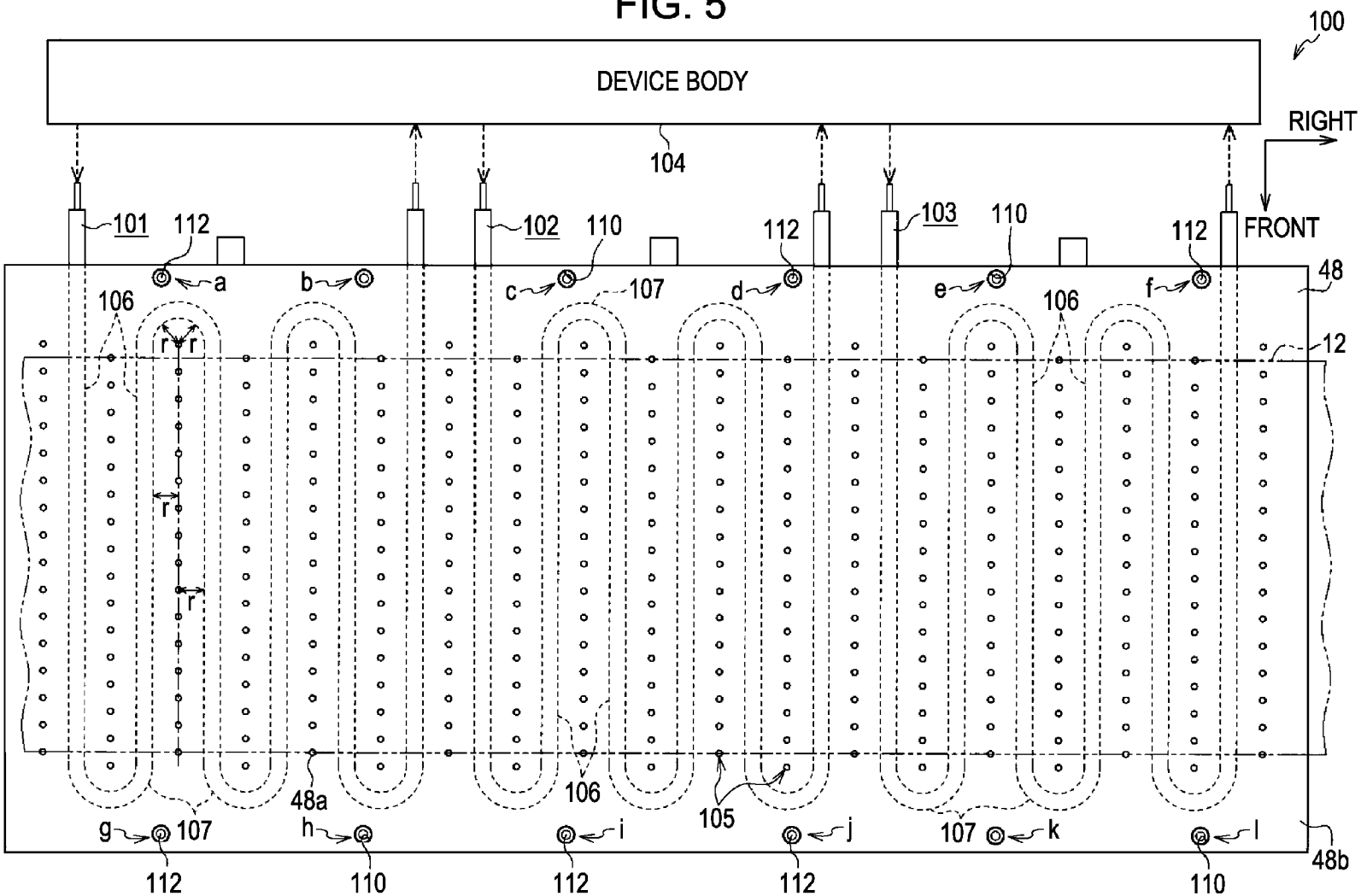
FIG. 5 is an enlarged plan view of a platen of the same printer.

As shown in FIG. 5, the platen 48 is formed with a number of suction holes 48*a* penetrating through the platen 48 in the vertical direction. The respective suction holes 48*a* are regularly arranged in such a manner that a plurality of rows of suction hole rows 105 formed by the plurality of suction holes 48*a* arranged in the fore-and-aft direction at predetermined pitches in the lateral direction.

A heating device 100 includes sheath heaters 101, 102, and 103 as a plurality of (three in this embodiment) heating means to be embedded in the platen 48 and a device body 104 for supplying electric currents independently to the sheath heaters 101, 102, and 103 for causing the respective sheath heaters 101, 102, and 103 to generate heat.

Then, when the sheath heaters 101, 102, and 103 generate heat, the generated heat is transmitted to the continuous sheet 12 being transported intermittently on the upper surface of the platen 48 via the platen 48, and the reverse surface, which is a non-printed surface, of the continuous sheet 12 is preheated. Therefore, in this embodiment, the platen 48 constitutes a preheating unit.

The sheath heaters 101, 102, and 103 are arranged in line in the lateral direction in the platen 48, and are adapted to generate heat respectively by being supplied with an electric current individually from the device body 104. Then, the heat generated by the respective sheath heaters 101, 102, and 103 is transmitted to the continuous sheet 12 on the platen 48 via the platen 48.

The respective sheath heaters 101, 102, and 103 each are formed by bending an elongated member at a plurality of positions. In other words, the sheath heaters 101, 102, and 103 include a plurality of (six in this embodiment) first heating portions 106 each of which extend in the fore-and-aft direction and are arranged between the suction hole rows 105 adjacent in the lateral direction, and a plurality of (five in this embodiment) second heating portions 107 which connect the first heating portions 106 arranged adjacently with the intermediary of the each suction hole row 105 in the lateral direction.

The first heating portions 106 each are formed to have a length in the fore-and-aft direction longer than the length of the suction hole rows 105 in the fore-and-aft direction. The first heating portions 106 are arranged at the laterally center of the both suction hole rows 105 positioned on both the left and right ends. Therefore, the distances between the first heating portions 106 and the suction hole rows 105 adjacent to the first heating portions 106 in the lateral direction are each a predetermined distance r.

The second heating portions 107 are formed into an arcuate shape having a center at suction holes 48*a* positioned at the endmost portions in the fore-and-aft direction of the suction hole rows 105 (direction of extension of the suction hole rows 105), which are the same position in the lateral direction. In other words, the second heating portions 107 on the front side of the suction hole rows 105 from among all the second heating portions 107 each are formed into an arcuate shape whose radius of curvature is the predetermined distance r and having the center at the frontmost suction hole 48*a* of the each suction hole row 105. The second heating portions 107 on the rear side of the suction hole rows 105 from among all the second heating portions 107 each are formed into an arcuate shape whose radius of curvature is a predetermined distance r and having the center at the rearmost suction hole 48*a* of the each suction hole row 105.

Subsequently, a supporting structure of the platen 48 will be described in detail.

Figure 6:
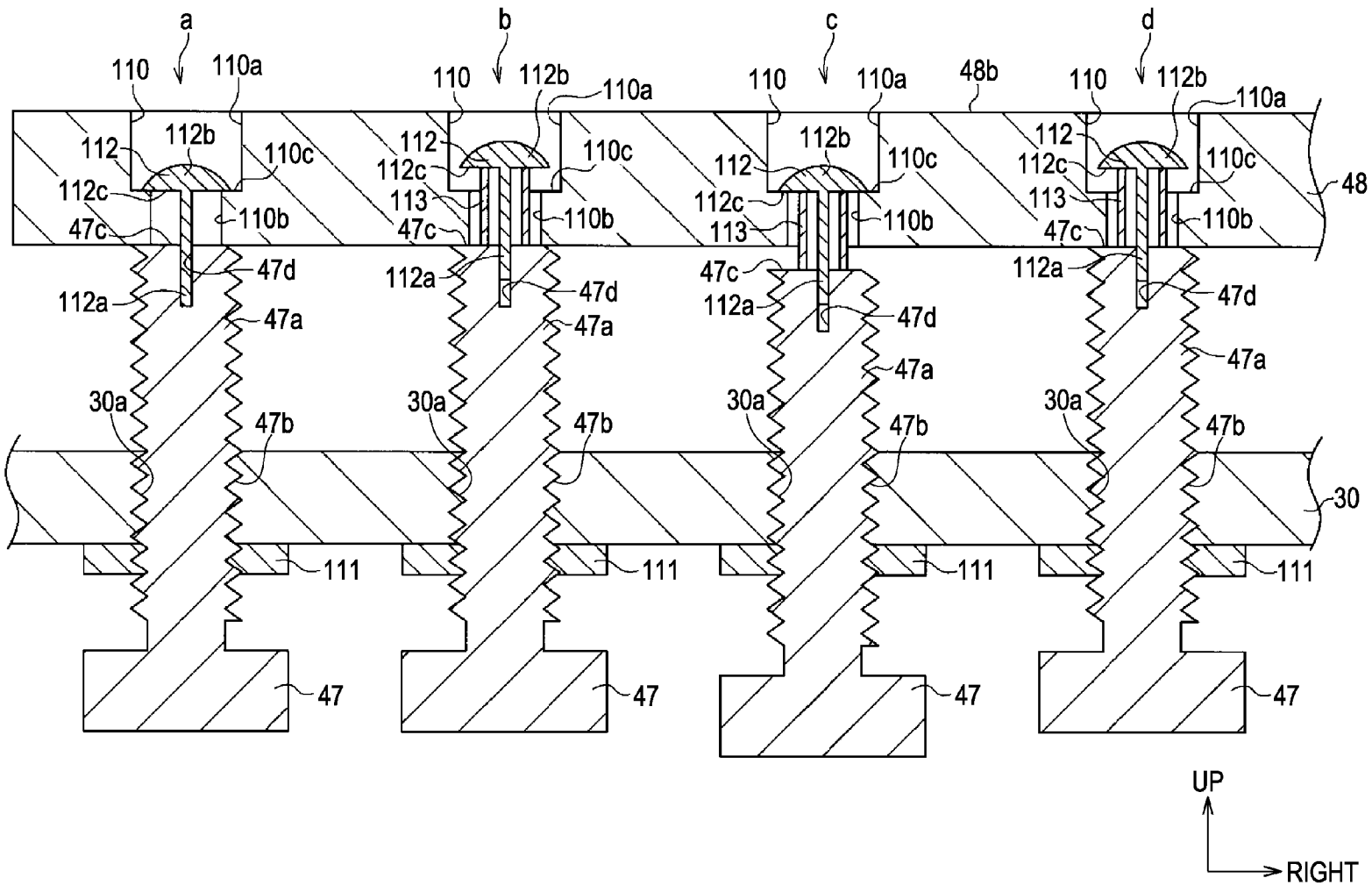
FIG. 6 is an enlarged cross section of a principal portion showing a supporting structure of the platen of the same printer.

As shown in FIG. 5 and FIG. 6, the platen 48 is supported on the base 30 via the jack bolts 47 as a plurality of supporting members. The platen 48 is formed with a plurality of (six in this embodiment) supporting holes 110 having a circular shape in plan view arranged on the rear end edge portion equidistantly in the lateral direction so as to penetrate therethrough in the vertical direction, and portions of the rear end edge portion of the platen 48 where the six supporting holes 110 are formed are supporting portions a to f from the left in sequence.

On the other hand, the platen 48 is formed with a plurality of (six in this embodiment) supporting holes 110 having a circular shape in plan view arranged on the front end edge portion equidistantly in the lateral direction so as to penetrate therethrough in the vertical direction, and portions of the front end edge portion of the platen 48 where the six supporting holes 110 are formed are supporting portions g to l from the left in sequence. Then, the supporting portions a to f oppose the supporting portions g to l with the intermediary of the center portion of the platen 48 in the fore-and-aft direction.

The supporting holes 110 at the respective supporting portions a to l of the platen 48 each include a large hole portion 110*a* on the upper side of a boundary at a substantially center portion in the vertical direction, and a small hole portion 110*b* as a through hole having a smaller inner diameter than the large hole portion 110*a* on the lower side. The surface between the large hole portion 110*a* and the small hole portion 110*b* of the supporting hole 110 is formed into a shouldered surface 110*c*, and the shouldered surface 110*c* is a horizontal surface extending in parallel with the upper surface 48*b* as the supporting surface of the platen 48 for supporting the continuous sheet 12.

The base 30 is formed with female screw holes 30*a* as female screw portions at positions corresponding to the respective supporting portions a to l of the platen 48 so as to penetrate therethrough in the vertical direction, and respective shaft portions 47*a* as column portions of the jack bolts 47 are screwed into the female screw holes 30*a* from the lower side. In other words, male screw portions 47*b* on the outer peripheral surface of the shaft portions 47*a* of the respective jack bolts 47 are screwed into the respective female screw holes 30*a* of the base 30, and the distal end portions (upper end portions) of the shaft portions 47*a* of the respective jack bolts 47 extend straight upward from the base 30.

Adjustment of the length of the shaft portion 47*a* of the jack bolt 47 projecting upward from the base 30 is achieved by screwing the jack bolt 47 forward or backward with respect to the female screw hole 30*a*. Therefore, the shaft portions 47*a* of the jack bolts 47 are supported by the base 30 so as to be moved freely in the vertical direction.

Lock nuts 111 as locking members for locking the jack bolts 47 from being screwed forward and backward with respect to the female screw holes 30*a* are screwed on the shaft portions 47*a* of the respective jack bolts 47 at positions lower than the base 30. In other words, movement of the shaft portions 47*a* of the jack bolts 47 in the vertical direction is restrained by rotating the lock nuts 111 so as to be brought into press-contact with the lower surface of the base 30.

Supporting Structure at Supporting Portion a of Platen 48

As shown in FIG. 6, the distal end surface (upper end surface) 47*c* of the shaft portion 47*a* of the jack bolt 47 corresponding to the supporting portion a of the platen 48 comes into contact with the lower surface of the supporting portion a of the platen 48, and female screw hole 47*d* is formed at the center portion of the distal end surface 47*c*. The truss screw 112 as a pressing member which constitutes the supporting mechanism is inserted into the supporting holes 110 at the supporting portion a of the platen 48 from the upper side. Then, a shaft portion 112*a* as the supporting portion of the truss screw 112 is inserted into the small hole portion 110*b* of the supporting hole 110 and is tightly screwed into the female screw hole 47*d* of the jack bolt 47.

Therefore, a gap is formed between the shaft portion 112*a* of the truss screw 112 and the inner peripheral surface of the small hole portion 110*b* of the supporting hole 110, and a lower surface 112*c* of a head portion 112*b* of the truss screw 112 is in press contact with the shouldered surface 110*c* of the each supporting hole 110 at a peripheral edge portion thereof. Furthermore, since the shaft portion 112*a* of the truss screw 112 is tightly screwed into the female screw hole 47*d* of the jack bolt 47 at the supporting portion a of the platen 48, the distal end surface 47*c* of the shaft portion 47*a* of the jack bolt 47 comes into press-contact with the lower surface of the platen 48.

In other words, the platen 48 is clamped by the lower surface 112*c* of the head portion 112*b* of the truss screw 112 and the distal end surface 47*c* of the shaft portion 47*a* of the jack bolt 47 at the supporting portion a. Therefore, the platen 48 is supported in a state of being completely fixed by the supporting mechanism (jack bolt 47 and the truss screw 112) at the supporting portion a.

Supporting Structure at Supporting Portion b of Platen 48

The supporting structure at the supporting portion b of the platen 48 is modified part of the supporting structure of the supporting portion a of the platen 48 described above, and hence only the modified point will be described.

As shown in FIG. 6, at the supporting portion b of the platen 48, a cylindrical spacer 113 is disposed in the small hole portion 110*b* of the supporting hole 110, and a gap is formed between the outer peripheral surface of the spacer 113 and the inner peripheral surface of the small hole portion 110*b*. In this case, the distance between the outer peripheral surface of the spacer 113 and the inner peripheral surface of the small hole portion 110*b* is set to an extent which is able to absorb thermal expansion sufficiently when the platen 48 is thermally expanded in the horizontal direction.

The spacer 113 is formed of ceramic having a smaller coefficient of thermal expansion than the metal which constitutes the platen 48. The shaft portion 112*a* of the truss screw 112 is inserted into the spacer 113, and a gap is formed between the inner peripheral surface of the spacer 113 and the outer peripheral surface of the shaft portion 112*a* of the truss screw 112.

The vertical length of the spacer 113 is set to be slightly longer than the vertical length of the small hole portion 110*b* of the supporting hole 110. The upper surface of the spacer 113 is in contact with the lower surface 112*c* of the head portion 112*b* of the truss screw 112, and the lower surface of the same is in contact with the distal end surfaces 47*c* of the shaft portions 47*a* of the jack bolts 47. Therefore, the lower surface 112*c* of the head portion 112*b* of the truss screw 112 and the distal end surface 47*c* of the shaft portion 47*a* of the jack bolt 47 are constantly kept apart by a certain distance (the vertical length of the spacer 113) which does not clamp the platen 48.

Since the distal end surface 47*c* of the shaft portion 47*a* of the jack bolt 47 comes into contact with the lower surface of the supporting portion b of the platen 48, the upper end portion of the spacer 113 projects upwardly of the shouldered surface 110*c* of the supporting hole 110.

In other words, the lower surface 112*c* of the head portion 112*b* of the truss screw 112 is apart from the shouldered surface 110*c* of the supporting hole 110 and the head portion 112*b* of the truss screw 112 is accommodated in the large hole portion 110*a* of the supporting hole 110. In this manner, the supporting mechanism in which the distal end surface 47*c* of the shaft portion 47*a* of the jack bolt 47 is in contact with the lower surface of the platen 48, and the lower surface 112*c* of the head portion 112*b* of the truss screw 112 is apart from the shouldered surface 110*c* of the supporting hole 110 is referred to as a first supporting mechanism. Therefore, the first supporting mechanism may be understood to be a mechanism which positions the platen 48 by the jack bolts 47 from the lower side and supports the platen 48 by the jack bolts 47 since the distal end surface 47*c* of the shaft portion 47*a* of the jack bolt 47 comes into contact with the platen 48 from the lower side.

Supporting Structure at Supporting Portion c of Platen 48

As shown in FIG. 6, the supporting structure at the supporting portion c of the platen 48 is similar to the supporting structure at the supporting portion b of the platen 48 described above, but the lower surface 112*c* of the head portion 112*b* of the truss screw 112 is brought into contact with the shouldered surface 110*c* of the supporting hole 110, and the distal end surface 47*c* of the shaft portion 47*a* of the jack bolt 47 is positioned apart from the lower surface of the platen 48. In this manner, the supporting mechanism in which the distal end surface 47*c* of the shaft portion 47*a* of the jack bolt 47 is apart from the lower surface of the platen 48, and the lower surface 112*c* of the head portion 112*b* of the truss screw 112 is in contact with the shouldered surface 110*c* of the supporting hole 110 is referred to as a second supporting mechanism. Therefore, the second supporting mechanism may be understood to be a mechanism which positions the platen 48 by the truss screw 112 supported by the jack bolt 47 via the shaft portion 112*a* from the upper side since the lower surface 112*c* of the head portion 112*b* of the truss screw 112 comes into contact with the platen 48 from the upper side.

The supporting portion c may be modified from the first supporting mechanism to the second supporting mechanism by moving the truss screw 112 and the jack bolt 47 set to the same height as the supporting portion b downward with respect to the platen 48 in a state of being kept at a distance which does not clamp the platen 48.

In the platen 48 in this embodiment, the respective supporting portions b, d, f, g, i, and k are supported by the first supporting mechanisms and the respective supporting portions c, e, h, j, and l are supported by the second supporting mechanisms. Therefore, the supporting portions b to l of the platen 48 are supported by the first supporting mechanisms and the second supporting mechanisms alternately in the lateral direction and the fore-and-aft direction. In other words, the first supporting mechanisms and the second supporting mechanisms are arranged alternately.

The platen 48 is configured in such a manner that the height at the supporting portion a supported so as to be fixed completely by the supporting mechanism is a reference height, and is supported horizontally by the supporting mechanisms at the respective supporting portions a to l. In this embodiment, the distal end surfaces 47*c* of the shaft portions 47*a* of the jack bolts 47 constitute first positioning portions which come into contact with the platen 48 from the lower side and position the platen 48 from the lower side, and the lower surfaces 112*c* of the head portions 112*b* of the truss screws 112 constitute second positioning portions which come into contact with the platen 48 from the upper side and position the platen 48 from the upper side.

Subsequently, an operation of the ink jet printer 11 configured as described above will be described.

When the printing job on the continuous sheet 12 which is to be printed for the first time on the platen 48 is completed, the portion having completed printing for the first time is transported downstream by a distance of the printing area A and stops temporarily. Therefore, the portion to be printed for the second time is transported onto the platen 48 and is supported. At this time, the most part of the continuous sheet 12 having completed printing for the first time is positioned in the forced dry area B, and the remaining portion is positioned in the natural dry area C.

Therefore, while the portion to be printed for the second time is being printed, most part of the portion of the continuous sheet 12 having completed printing for the first time is forcedly dried by being blasted with hot air in the forced dry area B, and the remaining portion is dried naturally in the natural dry area C. Subsequently, when the printing job on the continuous sheet 12 which is to be printed for the second time on the platen 48 is completed, the portion having completed printing for the second time is transported downstream by a distance of the printing area A and stops temporarily. Therefore, the portion to be printed for the third time is transported onto the platen 48 and is supported.

Then, in the continuous sheet 12, a portion of the portion having completed printing for the first time which has been positioned in the natural dry area C is positioned in the forced dry area B, and the portion which has been positioned in the forced dry area B is transported downstream of the forced dry area B. At this time, the most part of the continuous sheet 12 having completed printing for the second time is positioned in the forced dry area B, and the remaining portion is positioned in the natural dry area C.

Therefore, while the portion to be printed for the third time is being printed, most part of the portion of the continuous sheet 12 having completed printing for the second time is forcedly dried by being blasted with hot air in the forced dry area B, and the remaining portion is dried naturally in the natural dry area C. In this manner, the printing job is performed by the unit of the distance of the printing area A on the continuous sheet 12 in sequence.

While the printing job on the continuous sheet 12 is performed on the platen 48, since the platen 48 is being heated by the sheath heaters 101, 102, and 103, the heat radiated from the respective sheath heaters 101, 102, and 103 is transmitted to the continuous sheet 12 on the platen 48 via the platen 48. In other words, the reverse side (non-printing surface) of the continuous sheet 12 on the platen 48 is preheated by the platen 48.

Therefore, contact portions between the continuous sheet and the respective colors of ink ejected from the printhead 54 and dropped on the surface (printing surface) of the continuous sheet 12 at the time of printing on the continuous sheet 12 is immediately dried by the heat transmitted from the platen 48. Therefore, the respective colors of ink dropped on the surface of the continuous sheet 12 are fixed immediately on the surface of the continuous sheet 12. Therefore, the respective colors of ink dropped on the surface of the continuous sheet 12 at the time of printing on the continuous sheet 12 do not run until they reach the forced dry area B via the natural dry area C.

Here the platen 48 is heated by the sheath heaters 101, 102, and 103, and is thermally expanded in the horizontal direction by this heating. In other words, the platen 48, being formed into a rectangular plate shape, is thermally expanded in the horizontal direction while rarely expanding in the vertical direction (in the direction of thickness of the platen 48). Therefore, when the platen 48 is supported by being completely fixed at the respective supporting portions a to l, the force of thermal expansion of the platen 48 is trapped at the respective supporting portions a to l. Consequently, the platen 48 is thermally deformed so as to become wavy in particular between the respective supporting portions a to l on the upper surface 48*b* thereof.

Regarding this point, in this embodiment, the platen 48 is configured in such a manner that the respective supporting portions b, d, f, g, i, and k are supported by the first supporting mechanisms and the respective supporting portions c, e, h, j, and l are supported by the second supporting mechanisms. In other words, the platen 48 is configured in such a manner that the distal end surfaces 47*c* of the shaft portions 47*a* of the jack bolts 47 are in contact with the lower surface of the platen 48 at the respective supporting portions b, d, f, g, i, and k, and gaps each are formed between the lower surfaces 112*c* of the head portions 112*b* of the truss screws 112 and the shouldered surfaces 110*c* of the supporting hole 110. On the other hand, the platen 48 is configured in such a manner that gaps are formed between the distal end surfaces 47*c* of the shaft portions 47*a* of the jack bolts 47 and the lower surface of the platen 48 at the respective supporting portions c, e, h, j, and l, and the lower surfaces 112*c* of the head portions 112*b* of the truss screws 112 are in contact with the shouldered surfaces 110*c* of the supporting holes 110. In addition, gaps are formed between the outer peripheral surfaces of the spacers 113 and the inner peripheral surfaces of the small hole portions 110*b*.

Therefore, when the platen 48 is heated and is thermally expanded in the horizontal direction, which is a direction parallel to the upper surface 48*b*, the thermally expanded amount is absorbed by the gaps between the outer peripheral surfaces of the spacers 113 and the inner peripheral surfaces of the small hole portions 110*b*. In other words, the forces of thermal expansion of the platen 48 at the respective supporting portions a to l are released to the gaps between the outer peripheral surfaces of the spacers 113 and the inner peripheral surfaces of the small hole portions 110*b*.

At this time, the distal end surfaces 47*c* of the shaft portions 47*a* of the jack bolts 47 are in contact with the platen 48 from the lower side at the respective supporting portions b, d, f, g, i, and k supported by the first supporting mechanisms, and the lower surfaces 112*c* of the head portions 112*b* of the truss screws 112 are in contact with the platen 48 from the upper side at the respective supporting portions c, e, h, j, and l supported by the second supporting mechanisms. In addition, the first supporting mechanisms and the second supporting mechanisms are arranged alternately at the respective supporting portions b to l of the platen 48.

Therefore, the platen 48 is effectively prevented from rattling in the vertical direction and is positioned accurately in the vertical direction since the first supporting mechanisms and the second supporting mechanisms come into contact therewith at the respective supporting portions b to l vertically in a balanced manner. At this time, when the shouldered surfaces 110*c* of the supporting holes 110 are strongly pressed by the lower surfaces 112*c* of the head portions 112*b* of the truss screws 112 in the second supporting mechanism, the platen 48 is clamped between the second supporting mechanisms and the first supporting mechanisms, and hence the deformation caused by the thermal expansion cannot be released. Therefore, in the second supporting mechanism, the vertical length of the spacers 113 is set to be at a position which enables the truss screws 112 to prevent the platen 48 from being displaced upward and prevents the truss screw 112 from impairing relief of the platen 48 due to the thermal expansion.

In other words, the first supporting mechanisms and the second supporting mechanisms restrain the vertical position of the platen 48, and may come into contact with the platen 48 to an extent that the horizontal thermal expansion of the platen 48 is not impaired, or may not come into contact therewith. When the first supporting mechanisms and the second supporting mechanisms do not come into contact with the platen 48, the distances of the each first supporting mechanism and the each second supporting mechanism from the platen 48 are set to be about 0.05 to 0.1 mm. This is an allowable range of accuracy of the distance between the platen 48 and the printhead 54.

Since the amount of thermal expansion of the spacer 113 is smaller than that of the platen 48 at this time, the gap between the outer peripheral surfaces of the spacers 113 and the inner peripheral surfaces of the small hole portions 110*b* at the respective supporting portions b to l of the platen 48 are secured, so that the force of the thermal expansion of the platen 48 is prevented from being trapped.

When the upper surface 48*b* of the platen 48, which is the surface for supporting the continuous sheet 12, is thermally deformed and the accuracy of the upper surface 48*b* with respect to the horizontal surface is lowered, the upper surface 48*b* of the platen 48 may be corrected with respect to the horizontal plane by adjusting the supporting height of the platen 48 from the base 30 by the respective supporting mechanism at the respective supporting portions b to l by rotating the jack bolts 47 of the respective supporting mechanisms in a state in which the lock nuts 111 are released from the locked state. Then, by locking the jack bolts 47 by the lock nuts 111, the supporting height of the platen 48 from the base 30 at the respective supporting portions b to l is maintained. According to the embodiment as described above, the following effects are achieved.

(1) Since the gaps of a margin which is able to absorb the thermal expansion of the platen 48 in the horizontal direction sufficiently are formed between the outer peripheral surfaces of the spacers 113 and the inner peripheral surfaces of the small hole portions 110*b* at the respective supporting portions b to l of the platen 48, these gaps reliably absorb the amount of thermal expansion of the platen 48 in the horizontal direction. In addition, the first positioning portions of the first supporting mechanisms come into contact with the platen 48 at the respective supporting portions b, d, f, g, i, and k and the second positioning portions of the second supporting mechanisms come into contact therewith at the respective supporting portions c, e, h, j, and l. Accordingly, the vertical position of the platen 48 is determined, and hence the accuracy of the distance between the printhead 54 and the platen 48 at the time of printing is secured. In addition, the platen 48 is prevented from rattling in the vertical direction when the platen 48 is thermally expanded in the horizontal direction.

Therefore, the amount of thermal expansion of the platen 48 is absorbed while positioning the platen 48 vertically when the platen 48 is thermally expanded in the horizontal direction.

(2) Since the first supporting mechanisms and the second supporting mechanisms which support the respective supporting portions b to l of the platen 48 are arranged alternatively, the first supporting mechanisms and second supporting mechanisms come into contact with the platen 48 from the lower side to the upper side in a balanced manner. Therefore, the platen 48 is positioned all over the horizontal direction and the platen 48 is preferably prevented from rattling in the vertical direction when the platen 48 is thermally expanded in the horizontal direction.

(3) Since gaps are formed between the first supporting mechanisms and the second supporting mechanisms, respectively, and the platen 48, at least part of the thermally deformed portion at the respective supporting portions b to l of the platen 48 is absorbed by the respective gaps.

(4) The first positioning portion and the second positioning portion of each of the first supporting mechanism and the second supporting mechanism each include the spacer 113 therebetween so as to come into contact with both the first positioning portion and the second positioning portion. Therefore, the distance between the first positioning portion and the second positioning portion of each of the first supporting mechanism and the second supporting mechanism is kept constant (the length corresponding to the vertical length of the spacer 113) easily and accurately by the spacer 113.

(5) Since the spacer 113 is formed of a material having a smaller coefficient of thermal expansion than that of the material which constitutes the platen 48, the amount of thermal expansion of the spacer 113 is smaller than the amount of thermal expansion of the platen 48. Therefore, even when the platen 48 is thermally expanded in the horizontal direction, the gap formed between the outer peripheral surface of the spacer 113 and the inner peripheral surface of the small hole portion 110*b* is secured.

(6) Adjustment of the supporting height of the platen 48 from the base 30 by the respective supporting mechanisms is achieved by moving the jack bolts 47 vertically by rotating the jack bolts 47 which constitute the respective supporting mechanism. Therefore, for example, even when the platen 48 is inclined in a mounting state of being supported by the respective supporting mechanisms, the inclination of the platen 48 is corrected and hence the platen 48 is supported horizontally by adjusting the supporting height of the platen 48 from the base 30 by the respective supporting mechanisms. Consequently, the accuracy of the upper surface 48*b* of the platen 48, which is a surface for supporting the continuous sheet 12, with respect to the horizontal plane is secured.

(7) The respective supporting mechanisms for supporting the respective supporting portions b to l of the platen 48 are changed freely between the first supporting mechanism and the second supporting mechanism by moving the jack bolts 47 vertically by rotating the jack bolts 47 which constitute the respective supporting mechanisms after having supported the platen 48 on the base 30 by the respective supporting mechanisms. In other words, the first supporting mechanism and the second supporting mechanism are changed easily by moving the jack bolts 47 and the truss screws 112 with respect to the platen 48.

(8) Since the male screw portions 47*b* of the shaft portions 47*a* of the jack bolts 47 which constitute the respective supporting mechanisms are screwed into the respective female screw holes 30*a* of the base 30, adjustment of the supporting height of the platen 48 with respect to the base 30 by the respective supporting mechanisms is easily achieved smoothly by rotating the respective jack bolts 47 about the axial centers of the shaft portions 47*a*. Therefore, fine adjustment of the supporting height of the platen 48 with respect to the base 30 by the respective supporting mechanisms is achieved.

(9) Since the lock nuts 111 are screwed into the jack bolts 47 of the respective supporting mechanisms, the platen 48 is reliably maintained at the supporting height after adjustment by the respective supporting mechanisms by locking the respective jack bolts 47 by the lock nuts 111 after having adjusted the supporting height of the platen 48 from the base 30 by the respective supporting mechanisms.

(10) The platen 48 is positioned so as to be fixed vertically, laterally, and in the fore-and-aft direction completely by being clamped between the truss screw 112 and the jack bolt 47 only at the supporting position a. Therefore, the positioning of the platen 48 is achieved further accurately by setting the heights of the respective supporting portions b to l in the vertical direction with respect to to the supporting portion a. Since the platen 48 is completely fixed only at the supporting portion a, positioning of the platen 48 is achieved without fixing the same at the plurality of positions. Accordingly, the platen 48 is restrained from being thermally expanded and hence deformed to become wavy in the state of being fixed at the plurality of positions.

(11) Since the first supporting mechanism and the second supporting mechanism both include the jack bolt 47 and the truss screw 112, the members are commonly used for the respective supporting mechanisms.

(12) Since the shaft portions 112*a* of the truss screws 112 are inserted into the small hole portions 110*b* formed on the platen 48 with gaps for accommodating the thermal expansion of the platen 48, the thermal expansion of the platen 48 is accommodated. Since the shaft portions 112*a* of the truss screws 112 are inserted into the small hole portions 110*b* formed on the platen 48, flexibility in arrangement of the second supporting mechanism is increased. Since the head portions 112*b* of the truss screws 112 are accommodated in the supporting holes 110 of the platen 48, it is prevented from impairing the transportation of the continuous sheet 12.

Modification

The embodiment shown above may be modified as follows.

The spacers 113 do not necessarily have to be formed of the material having a coefficient of thermal expansion smaller than that of the platen 48.

The spacers 113 may be omitted.

In the first supporting mechanism and the second supporting mechanism, the each spacer 113 may be formed integrally with the distal end surface 47*c* of the shaft portion 47*a* of the jack bolt 47. Alternatively, in the first supporting mechanism and the second supporting mechanism, the each spacer 113 may be formed integrally with the lower surface 112*c* of the head portion 112*b* of the truss screw 112. In this configuration, the number of components is reduced.

In the first supporting mechanism and the second supporting mechanism, the shaft portion of the each truss screw 112 may be modified to be a needle shape so that the needle-shaped shaft portion of the truss screw 112 is picked into the distal end surface 47*c* of the shaft portion 47*a* of the jack bolt 47 for fixation.

In the first supporting mechanism, the truss screw 112 may be omitted. In this case, the spacer 113 is not necessary.

It is also possible to support the platen 48 by bringing the distal end surfaces 47*c* of the shaft portions 47*a* of the jack bolts 47 into contact with the respective supporting portions b, d, f, g, and k of the platen 48 and the distal end surfaces 47*c* of the shaft portions 47*a* of the jack bolts 47 into contact with the respective supporting portions c, e, h, j, and l from the upper side. In this case, members which support the jack bolts 47 which come into contact with the respective supporting portions c, e, h, j, and 1 of the platen 48 in a state of being screwed onto the jack bolts 47 on the upper side of the platen 48 is necessary. In this configuration, the truss screws 112 and the spacers 113 are not necessary.

The platen 48 may be arranged in such a manner that the upper surface 48*b* intersects the horizontal surface.

The first supporting mechanisms and the second supporting mechanisms which support the respective supporting portions b to l of the platen 48 do not necessarily have to be arranged alternately, and may be arranged at random. In this case, the number of the first supporting mechanisms and the second supporting mechanisms to be arranged may be arbitrary, it is necessary to arrange at least one each of the first supporting mechanism and the second supporting mechanism.

The respective supporting mechanisms may be configured so as not to be able to adjust the supporting height of the platen 48. In other words, simple column-shaped members fixed to the base 30 may be used in the respective supporting mechanisms instead of the jack bolts 47.

It is also possible to configure the platen 48 to be supported by being completely fixed by the supporting mechanism at any one of the respective supporting portions b to l other than the supporting portion a, and determine the height at the supporting portion supported by being completely fixed as a reference height. In this case, the supporting portion a in the platen 48 is supported by the first supporting mechanism or the second supporting mechanism.

The lock nuts 111 may be omitted.

It is also possible to use a rod-shaped sliding member supported with respect to the base 30 so as to be slidable in the vertical direction as the column member instead of the shaft portions 47*a* of the jack bolts 47. In other words, the sliding member is formed with a plurality of holes arranged at regular pitches in the vertical direction on the side surface thereof, and locking pins for locking the sliding member to the base 30 are removably inserted into the respective holes. In this configuration, adjustment of the supporting height of the platen 48 in stages by the sliding member is achieved by changing the hole of the sliding member to insert the locking pin.

It is also possible to use an elongated plastic film or the like as a target instead of the continuous sheet 12.

In the first supporting mechanism and the second supporting mechanism, the lower surface 112*c* of the head portion 112*b* of the truss screw 112 and the distal end surface 47*c* of the shaft portion 47*a* of the jack bolt 47 may come into contact with the platen 48 as long as it does not clamp and completely fix the platen 48. In other words, in this case, the first supporting mechanism and the second supporting mechanism have the common configuration.

The distance between the lower surface 112*c* of the head portion 112*b* of the truss screw 112 in the first supporting mechanism and the shouldered surface 110*c* of the supporting hole 110, and the distance between the distal end surface 47*c* of the shaft portion 47*a* of the jack bolt 47 in the second supporting mechanism and the platen 48 are not limited to the order of 0.05 to 0.1 mm. The distance preferably restrains the platen 48 from moving significantly in the vertical direction and falls in an allowable range for accuracy for the distance between the lower surface of the printhead 54 and the upper surface 48*b* of the platen 48.

It is also possible to bring the second positioning portion into contact with the peripheral edge of the platen 48 to position the platen 48 from the upper side instead of providing the supporting holes 110 on the platen 48.

In the embodiment shown above, the liquid ejecting apparatus is applied to the ink jet printer 11. However, it may be applied to the liquid ejecting apparatus which ejects liquid other than ink (including liquid state substances obtained by dispersing or mixing particles of functional material in liquid and fluid state substances such as gel). Then, the term "liquid" in this specification includes inorganic solvent, organic solvent, solution, liquid resin, liquid metal (metal melted solution), and so on, and also includes liquid state substances and fluid state substances.

In the above-described embodiment, the liquid ejecting apparatus is applied to the ink jet printer 11. However, a liquid ejecting apparatus which ejects or discharges liquid other than ink may also be employed. The liquid ejecting apparatus in this embodiment may be applied to various liquid ejecting apparatuses including a liquid ejecting head for discharging a minute amount of liquid drop. The term "liquid drop" indicates the state of liquid discharged from the liquid ejecting apparatus, and includes particle state, tear drop state, and thready state. The "liquid" here may be any material as long as the liquid ejecting apparatus is able to eject. For example, it may be a substance in the state of liquid phase, and includes not only liquid state substance having a high or low viscosity, fluid state substance such as inorganic solvent such as sol and gel water, organic solvent, solution, liquid state resin, liquid state metal (melted metal), or liquid as a state of the substance, but also those obtained by dissolving, dispersing or mixing particles of functional material formed of solid state substance such as pigment or metal particles in solvent. Representative examples of the liquid include ink as described in the embodiment and liquid crystal. The term "ink" here includes various liquid compositions such as general water-based ink and oil-based ink, gel ink, hot-melt ink. Detailed examples of the liquid ejecting apparatus include liquid ejecting apparatuses which eject materials such as liquid containing electrode material or colorant in the form of dispersion or dissolution used for manufacturing liquid crystal displays, EL (electroluminescence) displays, surface emission-type displays, or color filters, liquid ejecting apparatuses which eject biological organic substance used for manufacturing biochips, liquid ejecting apparatuses which are used as precision pipettes and eject liquid as a sample, text printing apparatuses, or microdispensers. In addition, the liquid ejecting apparatus that eject lubricant to precision instruments such as watches or cameras at pinpoint, liquid ejecting apparatuses that eject transparent resin liquid such as UV-cured resin on a substrate for forming minute semispherical lenses (optical lenses) used in optical communication elements, and liquid ejecting apparatuses that eject etching liquid such as acid or alkali for etching the substrate or the like may be employed. The invention may be applied to any one of the liquid ejecting apparatuses.

What is claimed is:

1. A liquid ejecting apparatus comprising:

a supporting member that supports a target transported from the upstream side;

a liquid ejecting head that ejects liquid toward the target supported by the supporting member;

a supporting mechanism that supports the supporting member; and a heating device that heats the supporting member, wherein the supporting mechanism includes a first supporting mechanism that positions the supporting member from the side opposite from a supporting surface which is a surface of the supporting member for supporting the target and is apart from the supporting member in the direction parallel to the supporting surface, and a second supporting mechanism that positions the supporting member from the side of the supporting surface, which is the surface of the supporting member for supporting the target and is apart from the supporting member in the direction parallel to the supporting surface, wherein the first supporting mechanism and the second supporting mechanism each include a positioning member that is able to support the supporting member, and the first supporting mechanism supports the supporting member and positions the supporting member by bringing a first positioning portion of the positioning member into contact with the supporting member, and the second supporting mechanism positions the supporting member by bringing a second positioning portion of a press-holding member supported by the positioning member via a supporting portion of the press-holding member into contact with the supporting member.

2. The liquid ejecting apparatus according to claim 1, wherein the supporting portion of the press-holding member is inserted into a through hole formed on the supporting member with a gap for accommodating thermal expansion of the supporting member.

3. The liquid ejecting apparatus according to claim 1, wherein the first supporting mechanism and the second supporting mechanism each include the positioning member and the press-holding member, and the positioning member and the press-holding member are adapted to be able to move with respect to the supporting member in a state in which the first positioning portion and the second positioning portion are kept at a distance which prevents the supporting member from being nipped.

4. The liquid ejecting apparatus according to claim 1, wherein in at least the second supporting mechanism from between the first supporting mechanism and the second supporting mechanism, a spacer which comes into contact with both the first positioning portion and the second positioning portion is provided between the first positioning portion and the second positioning portion with a gap for accommodating the thermal expansion of the supporting member provided with respect to the supporting member.

5. The liquid ejecting apparatus according to claim 4, wherein the spacer is formed of a material having a smaller coefficient of thermal expansion than that of the material which constitutes the supporting member.

6. The liquid ejecting apparatus according to claim 1, wherein the distance between the supporting member and the first supporting mechanism in the direction parallel to the supporting surface and the distance between the supporting member and the second supporting mechanism in the direction parallel to the supporting surface each are set to an extent that is able to absorb the amount of thermal expansion of the supporting member in the direction parallel to the supporting surface.

7. The liquid ejecting apparatus according to claim 1, wherein the first supporting mechanism and the second supporting mechanism are arranged alternately.

* * * * *